US008763706B2

(12) United States Patent
Lembcke

(10) Patent No.: US 8,763,706 B2
(45) Date of Patent: Jul. 1, 2014

(54) SELF-BOOSTING, NON-ELASTOMERIC RESILIENT SEAL FOR CHECK VALVE

(75) Inventor: Jeffrey J. Lembcke, Cypress, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 515 days.

(21) Appl. No.: 13/027,676

(22) Filed: Feb. 15, 2011

(65) Prior Publication Data

US 2012/0204977 A1 Aug. 16, 2012

(51) Int. Cl.
*E21B 34/06* (2006.01)

(52) U.S. Cl.
USPC ..... 166/325; 166/372

(58) Field of Classification Search
USPC ..... 166/372, 325; 137/155, 539, 535, 540, 137/536, 538
See application file for complete search history.

(56) References Cited

U.S. PATENT DOCUMENTS

| | | | | |
|---|---|---|---|---|
| 3,059,700 | A | 10/1962 | Loy, III et al. | |
| 3,967,679 | A * | 7/1976 | Liljestrand | 166/317 |
| 4,407,362 | A * | 10/1983 | Bechthold | 166/117.5 |
| 7,228,909 | B2 | 6/2007 | Schmidt et al. | |
| 7,681,650 | B2 * | 3/2010 | Telfer et al. | 166/386 |
| 2005/0126638 | A1 | 6/2005 | Gilbert | |
| 2006/0137881 | A1 | 6/2006 | Schmidt et al. | |
| 2010/0308517 | A1 * | 12/2010 | Goodson et al. | 267/154 |
| 2010/0319924 | A1 | 12/2010 | Mahmoud et al. | |

FOREIGN PATENT DOCUMENTS

| | | |
|---|---|---|
| GB | 2110272 | 6/1983 |
| WO | 2007014009 | 2/2007 |

OTHER PUBLICATIONS

"Energy, Oil and Gas seals: Explosive decompression," obtained from www.gaskets-seals.com/energy-oil-and-gas-seals.php, generated on Feb. 15, 2011, (C) 2011 Gatlin Corporation, 2 pages.
"FKM XokiR V9T20, Explosive Decompression Resistant Materials," Trelleborg Sealing Solutions, obtained from www.tss.trelleborg.com.
"Inject-Check (TM) Flow Control Device," Halliburton Completion Tools (c) 2010, obtained from www.halliburton.com Brochure No. H03786 Dec. 2010, 2 pages.
"15K Severe Service MTM Check Valve," Halliburton Completion Tools (c) 2011, obtained from www.halliburton.com Brochure No. H04352 Feb. 2011, 2 pages.

(Continued)

*Primary Examiner* — Nicole Coy
(74) *Attorney, Agent, or Firm* — Wong, Cabello, Lutsch, Rutherford & Brucculeri, LLP

(57) ABSTRACT

A check valve for gas lift applications can be attached externally to a side pocket mandrel or can be a gas lift valve used in the mandrel. The valve has a seat with a non-elastomeric element and a metal element. A biasing element resiliently biases the non-elastomeric element to provide resiliency to the seal produced. A metal dart moves in the bore relative to the seat and allows or prevents flow through the valve body. When exposed to a first differential pressure, the dart engages the non-elastomeric element resiliently biased by the biasing element. When exposed to a greater differential pressure, the dart engages the metal element, which can be part of the valve in the bore. In one arrangement, the non-elastomeric element can be a thermoplastic component with a metal spring energized seal as the biasing element. Alternatively, the non-elastomeric element can be the jacket of metal spring energized seal with a coil spring as the biasing element.

27 Claims, 7 Drawing Sheets

(56) References Cited

OTHER PUBLICATIONS

"Gas Lift Systems," Weatherford Artificial Lift Systems, obtained from www.weatherford.com (c) 2001, 6 pages.

"RF Series Production Pressure-Operated Valves," obtained from www.weatherford.com, (c) 2008, Brochure No. 1477.00, 2 pages.

"R-Series IPO Gas Lift Valves," obtained from www.weatherford.com, (c) 2005, Brochure No. 1475.00, 3 pages.

"Tubing-Retrievable Reverse-Flow Check Valves: CV Series," obtained from www.weatherford.com, (c) 2005-2007, Brochure No. 1492.01, 2 pages.

"Tubing-Retrievable (Conventional) Injection Pressure-Operated Gas-Lift Valves: C Series," obtained from www.weatherford.com, (c) 2005, Brochure No. 1489.00, 3 pages.

"Tubing-Retrievable, Injection Pressure, Pilot-Operated Gas-Lift Valves: CPV Series," obtained from www.weatherford.com, (c) 2005, Brochure No. 1491.00, 3 pages.

"Waterflood Injection Systems: Manage injection volume over a wide range of rates," obtained from www.weatherford.com, (c) 2009, Brochure No. 4553.00, 8 pages.

"SBRO-DVX Side-Pocket Gas-Lift Mandrel," obtained from www.weatherford.com, (c) 2005-2009, Brochure No. 1262.02, 2 pages.

European Search Report in corresponding European Appl. EP 12250030, dated Feb. 19, 2013.

* cited by examiner

SELF-BOOSTING, NON-ELASTOMERIC RESILIENT SEAL FOR CHECK VALVE

FIELD OF THE DISCLOSURE

The subject matter of the present disclosure is directed to a gas lift check valve, and more particularly to a seal arrangement for improved well integrity in gas lift completions.

BACKGROUND OF THE DISCLOSURE

Operators use gas lift valves in side pocket mandrels to lift produced fluids in a well to the surface. Ideally, the gas lift valves allow gas from the tubing annulus to enter the tubing through the valve, but prevent flow from the tubing to the annulus. A typical gas lift completion 10 illustrated in FIG. 1 has a wellhead 12 atop a casing 14 that passes through a formation. Tubing 20 positioned in the casing 14 has a number of side pocket mandrels 30 and a production packer 22. To conduct a gas lift operation, operators install gas lift valves 40 by slickline into the side pocket mandrels 30. One suitable example of a gas lift valve is the McMurry-Macco® gas lift valve available from Weatherford—the Assignee of the present disclosure. (McMURRY-MACCO is a registered trademark of Weatherford/Lamb, Inc.)

With the valves 40 installed, compressed gas G from the wellhead 12 is injected into the annulus 16 between the production tubing 20 and the casing 14. In the side pocket mandrels 30, the gas lift valves 40 then act as one-way valves by allowing gas flow from the annulus 16 to the tubing string 20 and preventing gas flow from the tubing 20 to the annulus 16. Downhole, the production packer 22 forces produced fluid entering casing perforations 15 from the formation to travel up through the tubing 20. Additionally, the packer 22 keeps the gas flow in the annulus 16 from entering the tubing 20.

The injected gas G passes down the annulus 16 until it reaches the side pocket mandrels 30. Entering the mandrel's ports 35, the gas G must first pass through the gas lift valve 40 before it can pass into the tubing string 20. Once in the tubing 20, the gas G can then rise to the surface, lifting produced fluid in the tubing 20 in the process.

As noted above, the installed gas lift valves 40 regulate the flow of gas from the annulus 16 to the tubing 20. To prevent fluid in the tubing 20 from passing out the valve 40 to the annulus 16, the gas lift valve 40 can use a check valve that restricts backflow.

One type of side pocket mandrel 30 is shown in more detail in FIGS. 2A-2B. This mandrel 30 is similar to a Double-Valved external (DVX) gas-lift mandrel, such as disclosed in U.S. Pat. No. 7,228,909 incorporated herein by reference in its entirety. The mandrel 30 has a side pocket 32 in an offset bulge from the mandrel's main passage 31. This pocket 32 holds the gas lift valve 40 as shown in FIG. 2B. The pocket's upper end has a seating profile 33 for engaging a locking mechanism of the gas lift valve 40, while the pocket's other end has an opening 34 to the mandrel's main passage 31.

Lower ports 36 in the mandrel's pocket 32 communicate with the surrounding annulus (16) and allow for fluid communication during gas lift operations. As shown in FIGS. 2A-2B, these ports 36 communicate along side passages 37 on either side of the pocket 32. When these passages 37 reach a seating area 39 of the pocket 32, these passages 37 communicate with the pocket 32 via transverse ports 38. In this way, fluid entering the ports 36 can flow along the side passage 37 to the transverse ports 38 and into the seating area 39 of the pocket 32 where portion of the gas lift valve 40 positions. As shown in FIG. 2B, the gas lift valve 40 has packings 43 that straddle and packoff the exit of the ports 38 in the mandrel's seating area 39. This is where inlets 42 of the gas lift valve 40 position to receive the flow of gas.

In the current arrangement, the ports 36 on the mandrel 30 can receive external check valves 50 that dispose in the ports 36. The check valves 50 allow gas G flow from the annulus (16) into the mandrel's ports 36, but prevent fluid flow in the reverse direction to the annulus (16). In general, the check valve 50 has a tubular body having two or more tubular members 52, 54 threadably connected to one another and having an O-ring seal 53 therebetween.

The upper end of the valve 50 threads into the mandrel's port 36, while the lower end can have female threads for attaching other components thereto. Internally, a compression spring 58 or the like biases a check dart 55 in the valve's bore against a seat 56. To open the one-way valve 50, pressure from the annulus (16) moves the check dart 55 away from the seat 56 against the bias of the spring 58. If backflow occurs, the dart 55 can seal against the seat 56 to prevent fluid flow out the check valve 50.

During gas lift, for example, the injected gas G can flow through the check valves 50, continue through separate flow paths in the ports 36 and passage 37, and then flow from the transverse ports 38 toward the inlets 42 of the gas lift valve 40. In turn, the gas lift valve 40 allows the gas G to flow downward within the valve 40, through a check valve 45, and eventually flow out through outlets 44 and into the side pocket 32. From there, the gas G flows out through the slot 34 in the mandrel 30 and into the production tubing (20) connected to the mandrel's main passage 31.

Because the gas lift valve 40 and the separate check valves 50 both prevent fluid flow from the tubing 20 into the annulus 16, they can act as redundant backups to one another. Moreover, the check valves 50 allow the gas lift valve 40 to be removed from the mandrel 30 for repair or replacement, while still preventing flow from the tubing 20 to the annulus 16. This can improve gas lift operations by eliminating the time and cost required to unload production fluid from the annulus 16 as typically encountered when gas lift valves are removed and replaced in conventional mandrels.

Various types of check valves can be used with gas lift valves or with other downhole components. For example, FIGS. 3A-3C illustrates types of prior art check valves for use with gas lift valves and mandrels. In particular, FIGS. 3A and 3B respectively show a CV-1 check valve 60A and a CV-2 check valve 60B from Weatherford's McMurry-Macco®CV series of reverse-flow check valves. These check valves 60A-B can attach to the bottom of a gas lift valve, to ports of a side pocket mandrel, or other flow-control device.

As shown, the check valves 60A-B each have an upper housing 62 threadably coupled to a lower housing 64 with an O-ring seal 63 therebetween. Disposed in the bore of the valves 60A-B, a dart 66 is biased by a spring 68 toward a seat 70. As shown in FIGS. 3A-3B, the seat 70 has an elastomeric component 72 and a retainer 74.

Another example of a check valve 60C is shown in FIG. 3C. This check valve 60C is similar to the DVX check valve available from Weatherford. This particular check valve 60C is well suited for a Double-Valved External (DVX) gas-lift mandrel described previously with reference to FIGS. 2A-2B. As shown, this check valve 60C includes an upper body 62 coupled to a lower body 64 by a port housing 65 and O-rings 63. As before, the check dart 66 can move in the port housing 65 against the bias of a spring 68 relative to a seat 70. Here, the seat 70 has a check seal 72 typically composed of elastomer (i.e., elastic polymer), such as nitrile butadiene rubber, hydrogenated nitrile butadiene rubber, fluorocarbon rubber, tetra-fluoro-ethylene-propylene, and perfluoroelastomers.

During a gas lift operation, upstream pressure typically from the surrounding annulus acts against the check valve 60A-C and is higher than the downstream pressure from the tubing. The pressure differential depresses the spring-loaded dart 66 in the valve 60A-C, allowing injection gas to flow through the check valve 60A-C and into the production tubing. If the downstream pressure is greater than the upstream pressure, flow across the check dart 66 forces the dart 66 against the seat 17, which prevents backflow. In the seating process, an elastomeric seal is first established between the dart 66 and elastomeric component 72. As the differential pressure increases, a metal-to-metal seal is then formed for additional protection between the dart 66 and portion of the lower housing 64 forming part of the seat 70.

As seen in FIGS. 3A-3C, check valves 60A-C for gas lift valves use elastomeric resilient seals 72 to provide a secondary seal to the metal-to-metal seal between the check dart 66 and the seat 70. As expected, such a dual seal protects against backflow, prevents casing from damage, and avoids costly workover operations. Unfortunately, the elastomeric seal 72 can be prone to explosive decompression during use.

In explosive decompression, the seal 72 is exposed to gas laden fluid at high pressure, and the compressed gas enters the interstices of the seal's elastomer. As long as operating pressures remain high, the seal 72 remains intact. Whenever the pressure falls, however, the gas in the elastomer of the seal 72 expands and can cause the seal 72 to rupture.

Explosive decompression has been a recognized problem in valve seals, and two solutions have been developed for handling it. In a first solution, specific types of elastomers have been developed that are more resistant than others to explosive decompression. An example of such an elastomer is FKM XploR V9T20, which is available from Trelleborg Sealing Solutions. Although these types of elastomers may be useful, even seals with such elastomers can still have issues with explosive decompression in check valves used for gas lift operations.

Another solution developed in the art has been to use only metal-to-metal sealing with no resilient seal in check valves. An example of such a check valve with only metal-to-metal sealing is the 15K Severe Service MTM Check Valve available from Halliburton. Although exclusive metal sealing may solve problems related to explosive decompression, a check valve utilizing only a metal-to-metal seal can be less reliable in sealing, especially if there is any debris present in the injection fluid. Moreover, the exclusive metal-to-metal seal can be costly to manufacture and maintain.

The subject matter of the present disclosure is directed to overcoming, or at least reducing the effects of, one or more of the problems set forth above.

SUMMARY

A check valve apparatus for a gas lift application can be used as an external check valve attached to the outside of a side pocket mandrel that holds a gas lift valve therein. Alternatively, the check valve apparatus can actually be part of a gas lift valve or any other type of valve.

The apparatus has a valve body with a seat and dart disposed in the valve's bore. The seat has a first seal element composed of a non-elastomeric material and has a second seal element composed of a metal material. Being non-elastomeric material, the first seal element can be composed of a thermoplastic, such as polytetrafluoroethylene (PTFE), a moly-filed PTFE, or polyetheretherketone (PEEK). A biasing element, such as a spring, resiliently biases this first (non-elastomeric) seal element of the seat to provide resiliency to the seal produced.

When the dart composed of a metal material moves in the valve's bore relative to the seat, the dart allows or prevents flow through the valve body by engaging or disengaging the seat. When exposed to proper flow from the annulus to the mandrel, the dart moves against the bias of the dart's spring away from the seat. When exposed to a first differential pressure from backflow, however, the dart engages the first (non-elastomeric) seal element resiliently biased by the biasing element. When exposed to a greater differential pressure, the dart further engages the second (metal) seal element, which can include portion of the valve body in the bore.

In one arrangement, the biasing element is an energized seal disposed in a face seal configuration that biases the first seal element axially along the bore. This energized seal can be a metal spring energized seal having a jacket with a metal finger spring disposed therein. In another arrangement, the first seal element can be a jacket of an energized seal, while the biasing element is a spring of the energized seal disposed in the jacket. The energized seal in this arrangement can be a metal spring energized seal disposed in a rod and piston seal configuration and can bias transversely to the bore. The spring can use a coil spring for this energized seal.

The foregoing summary is not intended to summarize each potential embodiment or every aspect of the present disclosure.

DETAILED DESCRIPTION

Figure 4:
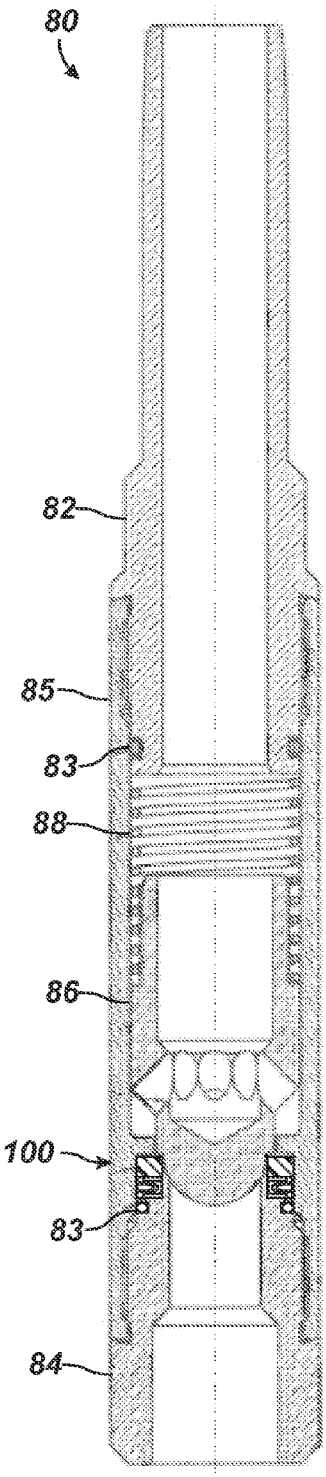
FIG. 4 illustrates a cross-section of a check valve with one seat arrangement according to certain teachings of the present disclosure.

A gas lift check valve 80 illustrated in FIG. 4 has a seat arrangement 100 according to the present disclosure. As before, the check valve 80 includes an upper body 82 coupled to a lower body 84 by a port housing 85 and O-rings 83. A check dart 86 can move in the port housing 85 against the bias of a spring 88 relative to the seat arrangement 100.

Figure 1:
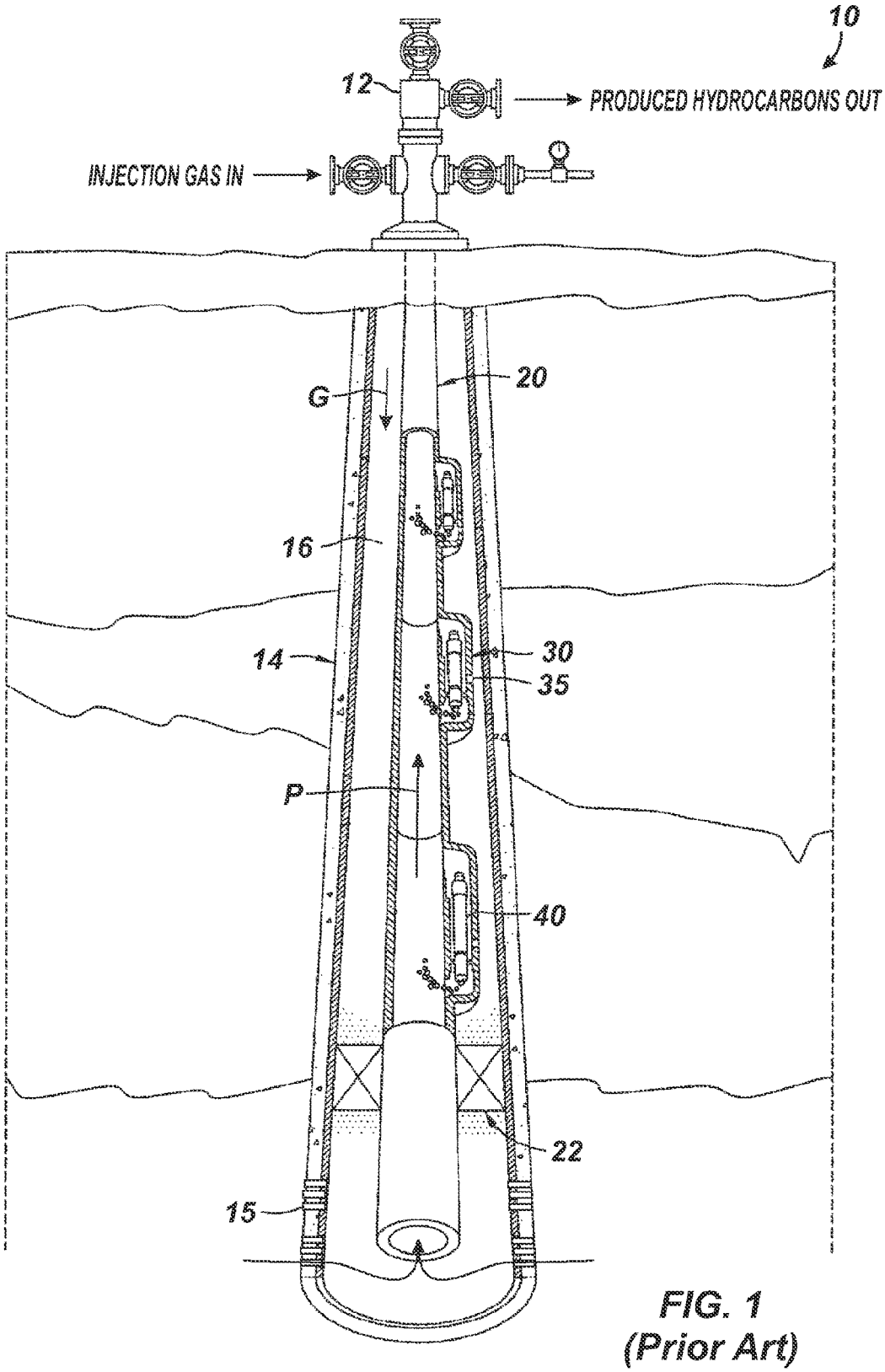
FIG. 1 (Prior Art)
FIG. 1 illustrates a typical gas lift completion.
Figure 2A:
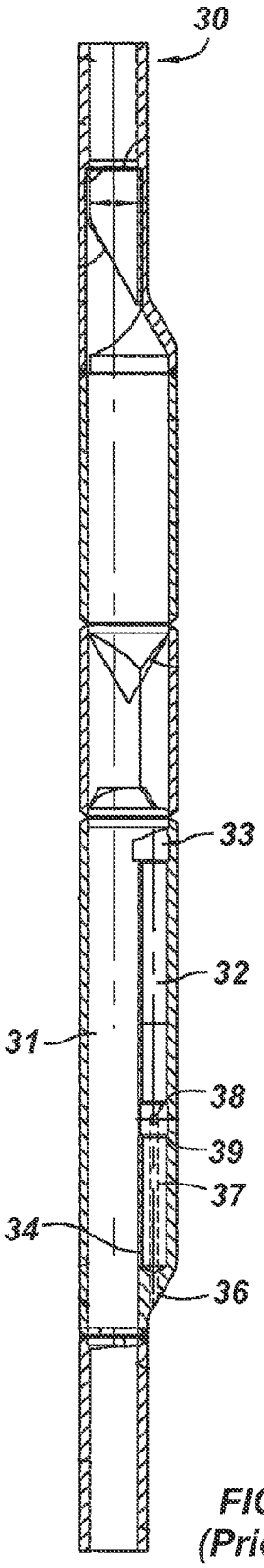
FIG. 2A (Prior Art)
FIG. 2A illustrates a side pocket mandrel according to the prior art for use with dual external check valves.
Figure 2B:
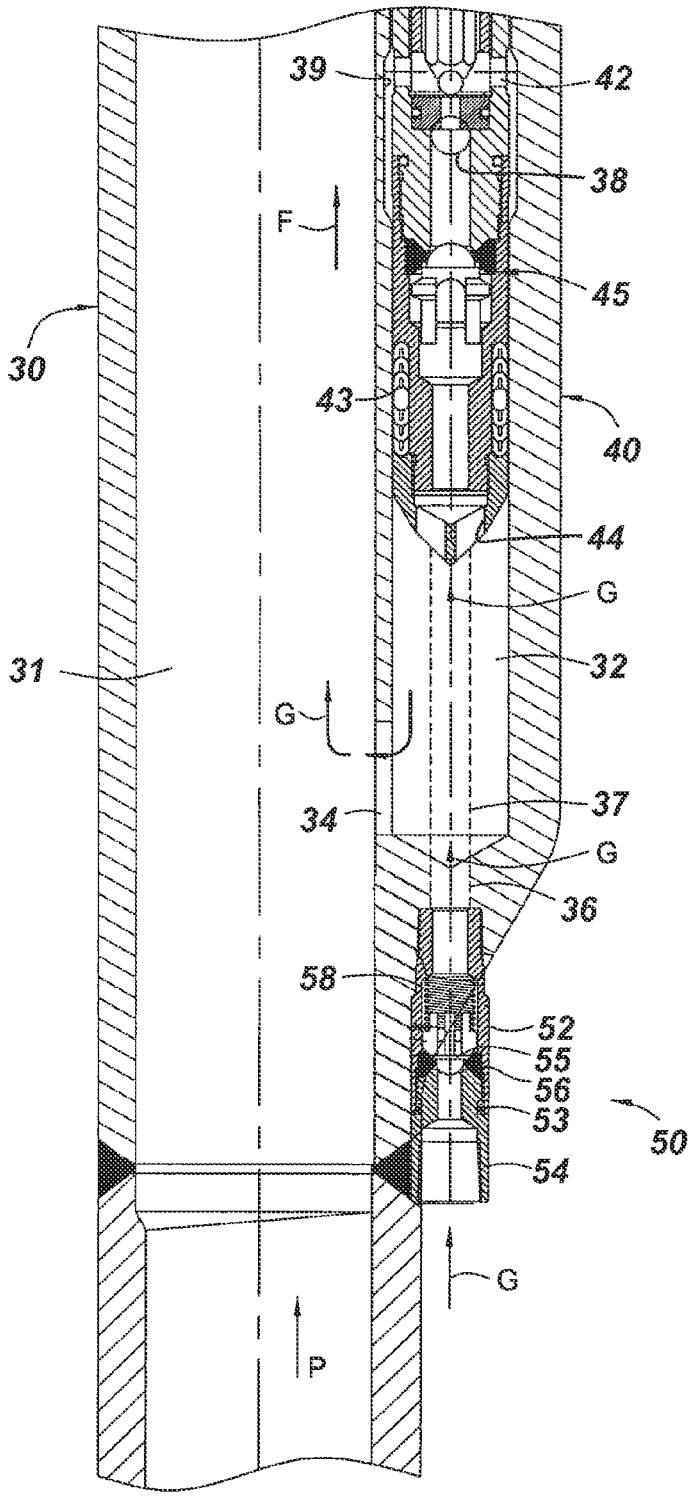
FIG. 2B (Prior Art)
FIG. 2B illustrates portion of a gas lift valve positioned in the side pocket mandrel of FIG. 2A with an external check valve disposed thereon.
Figure 3A:
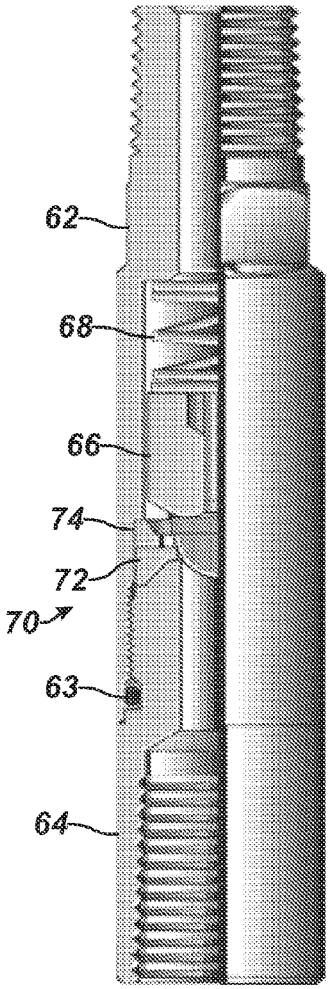
FIG. 3A (Prior Art)
FIGS. 3A-3C illustrate prior art check valves.
Figure 3B:
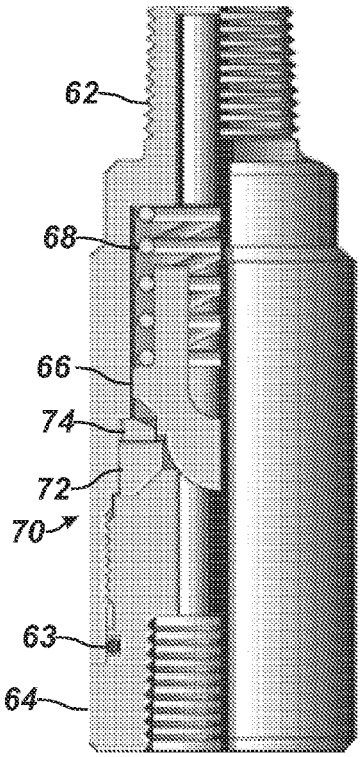
FIG. 3B (Prior Art)
Figure 3C:
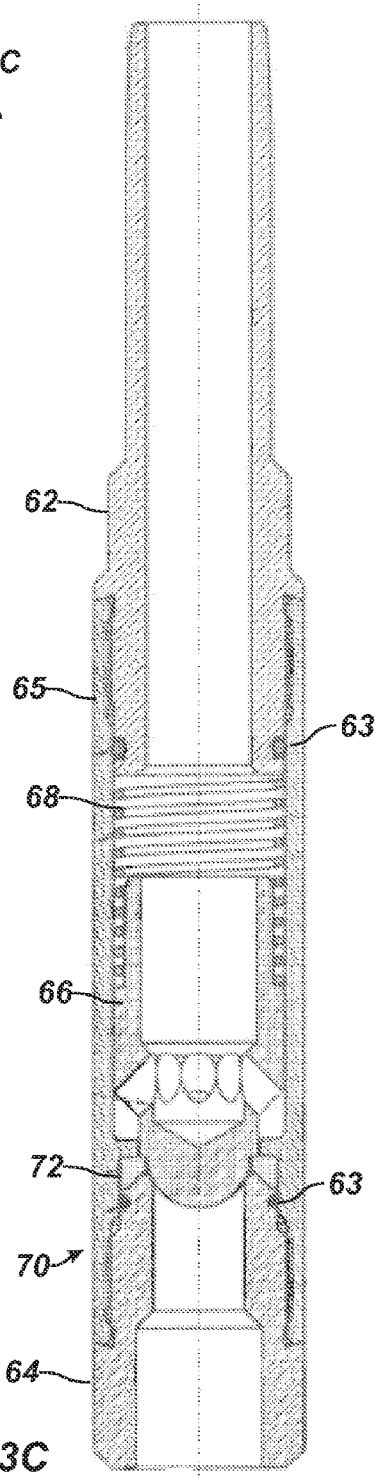
FIG. 3C (Prior Art)

This valve 80 is well suited for the Double-Valved external (DVX) gas-lift mandrel, such as described previously with reference to FIGS. 2A-2B and disclosed in the incorporated U.S. Pat. No. 7,228,909. However, the check valve 80 with its seat arrangement 100 can be used in other implementations and can be attached directly to a gas lift valve or other flow control device that either has or does not have its own one-way valve. Moreover, multiple check valves 80 can be screwed together to create multiple check barriers for additional protection against backflow.

Figure 5A:
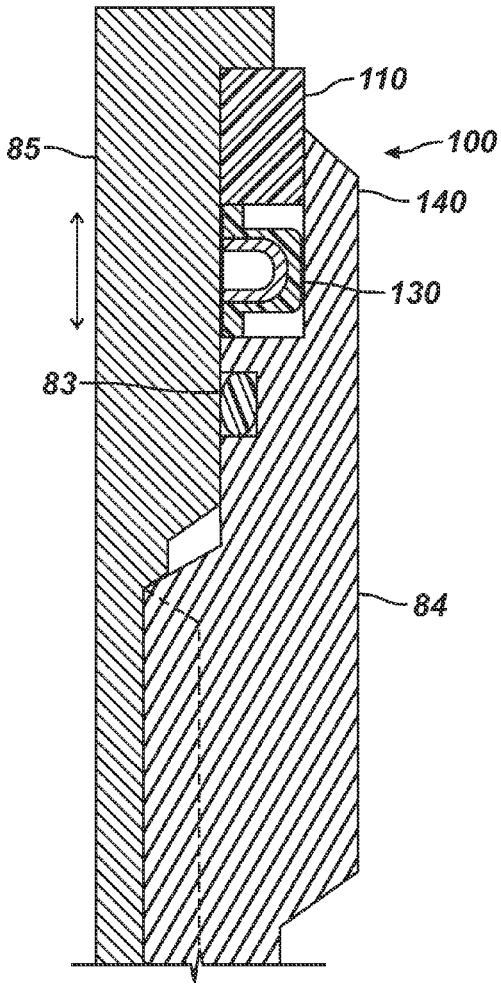
FIG. 5A illustrates a detail of the seat arrangement for the check valve of FIG. 4.

As shown in FIG. 5A, the seat arrangement 100 includes a check seal 110 and a spring loaded cup seal 130 arranged between the port housing 85 and the lower body 84. The check seal 110 is composed of non-elastomeric material, such as polytetrafluoroethylene (PTFE) or moly-filed PTFE polytetrafluoroethylene, molybdenum sulfide ($MoS_2$) Filled, which is also known as Teflon®). (TEFLON is a registered trademark of E. I. Du Pont De Nemours and Company Corporation.) Other suitable materials that are non-elastomeric include other thermoplastic polymers.

Figure 5B:
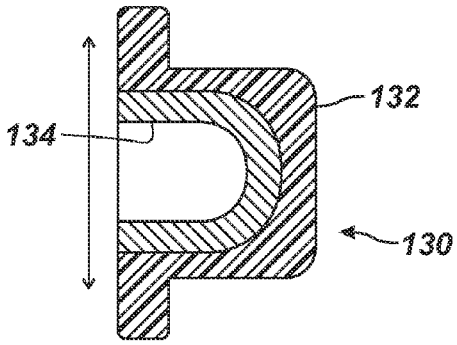
FIG. 5B illustrates a cross-sectional detail of the spring loaded cup seal for the disclosed seat arrangement.

Because the check seal 110 is non-elastomeric, it lacks the resiliency typically provided for check valve seals using elastomer. For this reason, the spring loaded cup seal 130 is used to provide resiliency to the seat arrangement 100. The cup seal 130 is arranged in a face seal configuration and biases the check seal 110 relative to the lower housing 84. As shown in the cross-sectional detail of FIG. 5B, the spring loaded cup seal 130 has a jacket 132 in which a spring element 134 is disposed. The jacket 132 is composed of non-elastomeric material, such as PTFE or the like, while the spring element 134 is composed of non-corrosive metal or other suitable material.

As shown in FIGS. 4 and 5A, the resiliency of the cup seal 130 acts axially along the valve 80 and acts against the seating direction of the dart 86. As fluid pressure in the valve 80 builds and/or the bias of the spring 88 acts to seat the dart 86 on the seat arrangement 100, the check dart 66 engages the seat arrangement 100 to prevent backflow. In the seating process, the non-elastomeric seal from the check seal 110 is first established with the dart 66, and the resiliency for this seal is provided by the bias of the cup seal 130. As the differential pressure increases, a metal-to-metal seal is then formed for additional protection, as the dart 66 engages an inside metal area 140 (FIG. 5A) of the lower housing 84 around the valve's seat arrangement 100.

Figure 6:
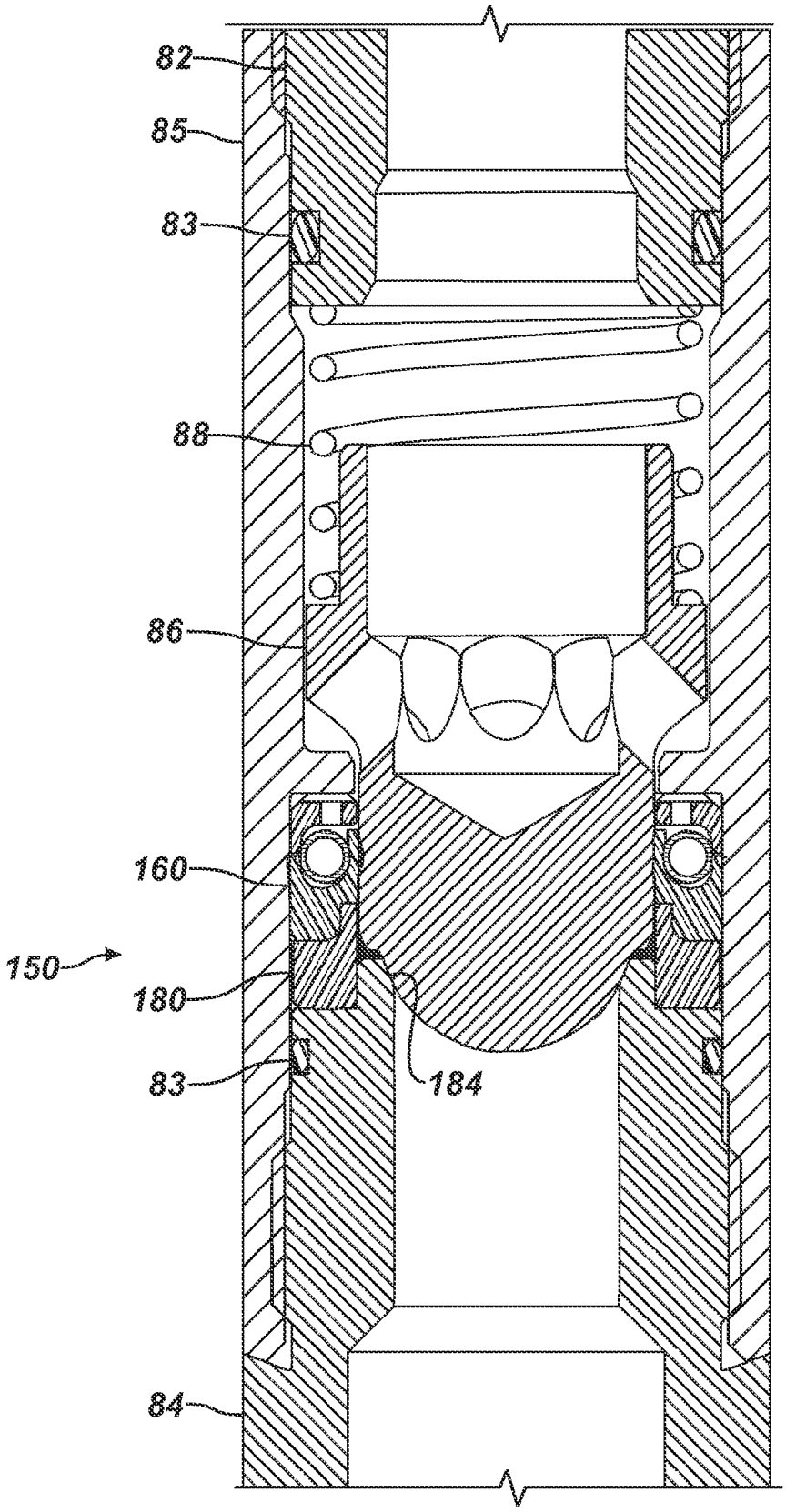
FIG. 6 illustrates a cross-section of a check valve with another seat arrangement according to certain teachings of the present disclosure.
Figure 7A:
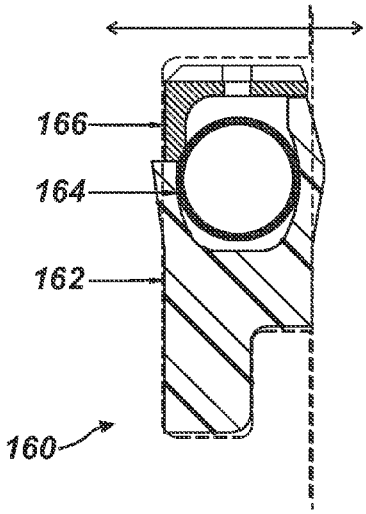
FIG. 7A illustrates a detail of the seat arrangement for the check valve of FIG. 6.
Figure 7B:
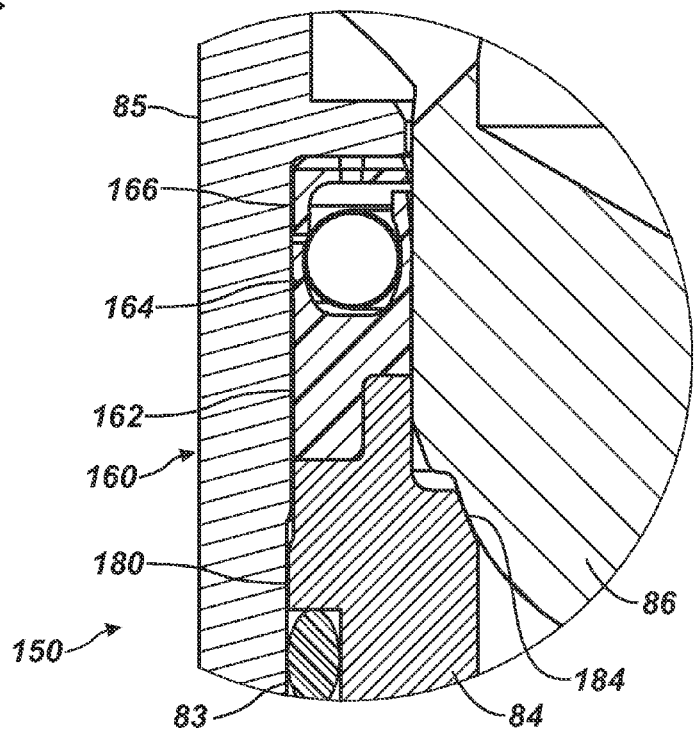
FIG. 7B illustrates another configuration for the seat arrangement of FIG. 6.

Another seat arrangement 150 for the check valve 80 illustrated in FIG. 6 has a spring loaded cup seal 160 and a retaining element 180. FIG. 7A illustrates a detail of the check seal 160 for the check valve of FIG. 6, while FIG. 7B illustrates the spring loaded cup seal 160 in greater detail relative to the check dart 86 and other valve components. In FIGS. 6 and 7A-7B, components of the valve 80 are similar to those described previously so the same reference numerals are used.

As before, the seat arrangement 150 uses a non-elastomeric material and a spring mechanism for the check seal 160. This seat arrangement 150 differs somewhat from the previous arrangement 100 in that the bias or resiliency of the check seal 160 is orthogonal to the axis of the check valve 80. Rather than a face configuration, for example, the check seal 160 is disposed in a rod and piston seal configuration. As shown in FIGS. 7A-7B, the resiliency of the check seal 160 therefore acts transversely to the valve 80's longitudinal axis. In this way, the check seal 160 presses outward into the valve's bore and acts orthogonally to the seating direction of the dart 86 as shown in FIG. 7B.

As shown in FIG. 6, the retaining element 180 can be composed of non-elastomeric material, such as PTFE or metal. Disposed between the mated housings 84 and 85, the retaining element 180 helps retain or hold the check seal 160 and may facilitate assembly. As an alternative shown in FIG. 7B, the seat arrangement 150 can lack a retaining element (180). Instead, the lower housing portion 84 is configured to directly retain the check seal 160 as well as provide the metal area for the metal-to-metal seal with the check dart 86. As will be appreciated, these and other suitable configurations can be used to retain the check seal 160 in the valve 80.

As best shown in FIGS. 7A-7B, the check seal 160 has a jacket 162, a coil spring 164, and a hat ring 164. The jacket 162 and hat ring 164 are both preferably composed on non-elastomeric materials. For example, the jacket 162 can be composed of PTFE, such as Avalon® 56 or the like, while the hat ring 164 can be composed of polyetheretherketone (PEEK), such as Arlon® 1000 or the like. (AVALON and ARLON are registered trademarks of Green, Tweed & Co. of Kulpsville, Pa.) The coil spring 164 is preferably composed of corrosive resistant metal, such as Elgiloy® 58% Cr or the like. (ELGILOY is a registered trademark of Elgiloy Company.)

As shown in FIGS. 6 and 7A-7B, fluid pressure in the valve 80 builds and/or the bias of the spring 88 acts to seat the dart 86 on the seat arrangement 150 so the check dart 66 engages the seat arrangement 150 to prevent backflow. In the seating process, the non-elastomeric seal from check seal 160 is first established with the dart 66, and the resiliency for this seal is provided transversely by the biasing element of the check seal 160. As the differential pressure increases, a metal-to-metal seal is then formed for additional protection, as the dart 66 engages an inside metal area 184 around the valve's seat arrangement 150.

As evidenced by the present disclosure, the disclosed seat arrangements (i.e., 100 and 150) can overcome issues typically encountered in check valves. By using the non-elastomeric material for the resilient seal, for example, issues with explosive decompression can be avoided completely, yet the seal can still provide high sealing integrity even if debris is present. The biasing elements (e.g., cup seal 130 or spring loaded check seal 160) give resiliency to the seat arrangements 100, 150 even though the non-elastomeric materials of the seat arrangements 100, 150 do not have any elasticity. This resiliency by the biasing elements can actually provide a boost to the resilient seal and help it seal even more reliably as an unexpected benefit. In this way, the more pressure present on the check valve actually produces more force between the resilient seal and the check valve 80 and further enhances the seal produced.

Figure 7C:
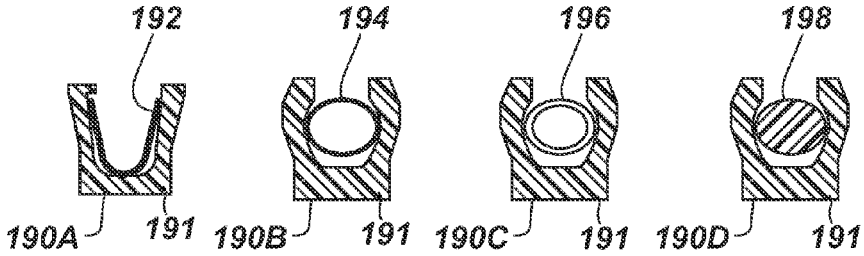
FIG. 7C illustrates various energized seals for use in the seat arrangements of the present disclosure.

The seating arrangements 100, 150 disclosed herein can use an energized seal. For example, any of the various metal spring energized seals (i.e., an MSE® seal) known in the art can be used in face or piston and rod seal configurations depending on the arrangement. (MSE is a registered trademark of Green, Tweed & Co. of Kulpsville, Pa.) FIG. 7C shows various energized seals 190A-C that can be used as a resiliency element (as in FIG. 5A), a check seal element (as in FIG. 6), or both.

In general, the energized seals 190A-C have a ring-shaped jacket 191 composed of non-elastomeric polymer, such as PTFE, and have a biasing element 192, 194, or 196 that energizes the polymer jacket 191. When seated in the jacket 191, the biasing element 192, 194, or 196 is under compression and applies force against the jacket's sides. For example, the energized seals 190A-C can use biasing elements, including a finger spring 192, a coil spring 194, and a double coil spring 196, each of which is preferably composed of metal. By contrast, seal 190D uses an O-ring 198 in the jacket 191 and may be suitable for some applications.

Figure 8:
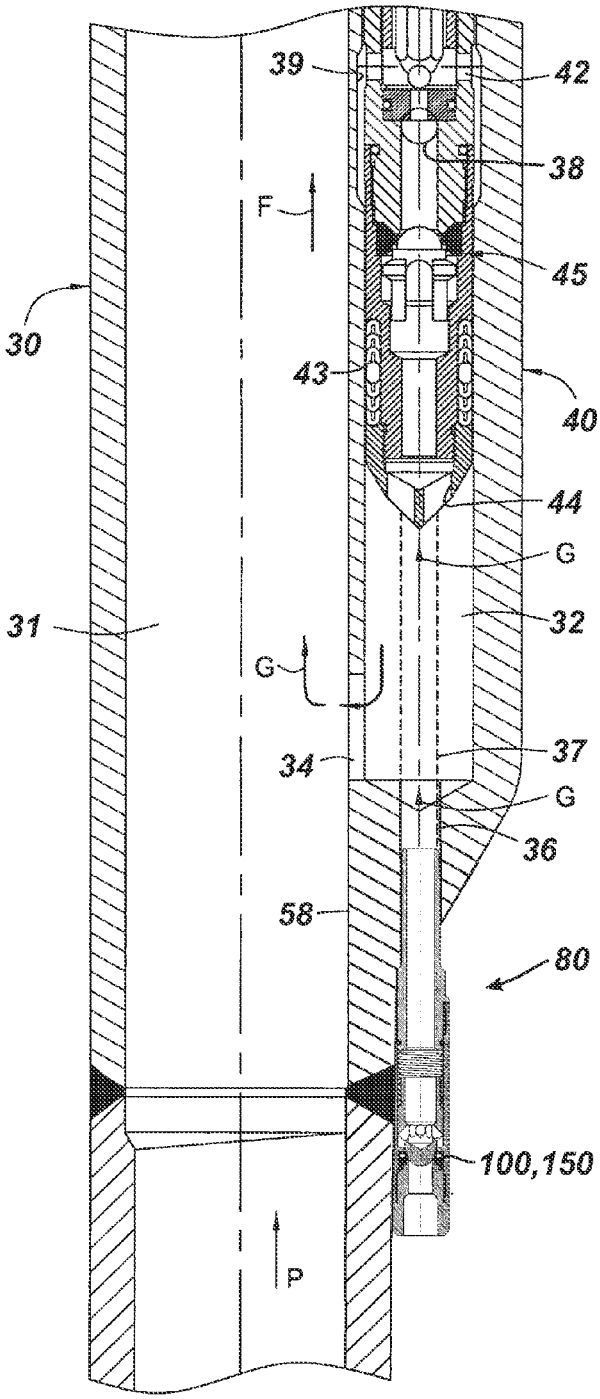
FIG. 8 illustrates a side pocket mandrel with an external check valve having the disclosed seat arrangement.

As noted herein, the check valve 80 of FIG. 6 can attach to the port of a side pocket mandrel. For example, FIG. 8 shows the check valve 80 having the disclosed seat arrangement 100,150 attached to the external port 36 of the side pocket mandrel 30. (Similar reference numbers are used for like components discussed previously.) The valve 80 can thread into the external port 36 or attach in any other suitable manner. In this way, the valve 80 can act as a redundant check valve to prevent backflow and can operate as the one-way valve when the gas lift valve 40 is removed from the side pocket 32 for repair or replacement.

Figure 9:
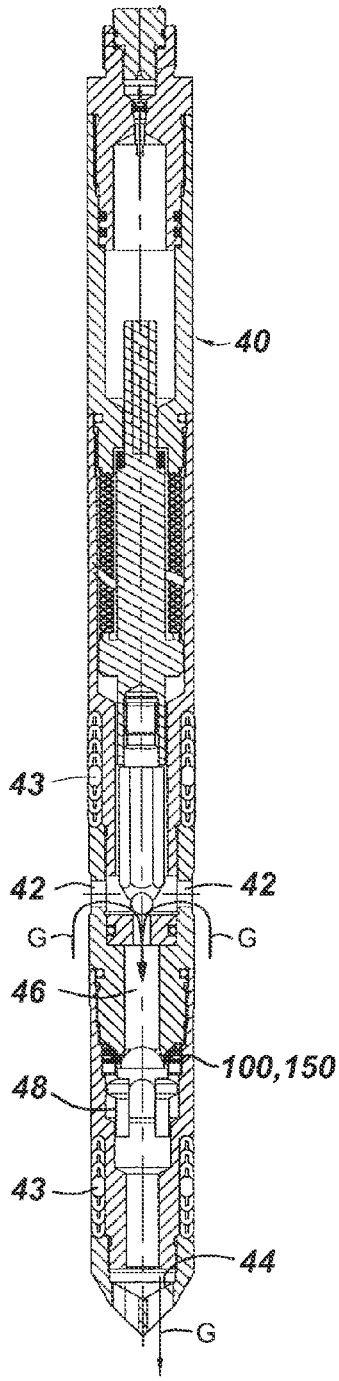
FIG. 9 illustrates a gas lift valve having the disclosed seat arrangement.

Although discussed in relation to an external check valve, the disclosed seat arrangements 100,150 may actually be used with any poppet-type sealing device that requires a gas tight seal. As one example, even a gas lift valve 40 as shown in FIG. 9 can use the seat arrangement 100,150 of the present disclosure in conjunction with its internal check dart 48. (Similar reference numbers are used for like components discussed previously.)

As shown, the retrievable, one-way check valve in the gas lift valve 40 disposing in a side pocket mandrel may use the disclosed seat arrangement 100,150. In this way, the seat arrangement 100,150 operates in conjunction with the gas lift valve's dart 48 to allow flow through the valve's internal passage 46 from the inlets 42 to the outlets 44 and prevent backflow in the reverse direction.

The foregoing description of preferred and other embodiments is not intended to limit or restrict the scope or applicability of the inventive concepts conceived of by the Applicants. Various types of materials have been discussed herein. For the sake of understanding and without limitation to the claims and available materials, elastomer refers to polymers that are elastic (i.e., NBR, HNBR, FKM, TFE/P, FFKM, and the like), while thermoplastic refers to polymers that are not elastic and do not recover upon deformation (i.e., PTFE, PEEK, PPS, PAI, PA, EDPM+PP, PVDF, ECTFE, and the like).

In exchange for disclosing the inventive concepts contained herein, the Applicants desire all patent rights afforded by the appended claims. Therefore, it is intended that the appended claims include all modifications and alterations to the full extent that they come within the scope of the following claims or the equivalents thereof.

What is claimed is:

1. A check valve apparatus for controlling fluid flow in a gas lift application, comprising:

a body defining a bore;

a seat disposed in the bore and permitting the fluid flow therethrough, the seat having first and second seal elements disposed adjacent one another on the seat, the first seal element being composed of a non-elastomeric material, the second seal element being composed of a metal material;

a biasing element disposed on the seat and resiliently biasing the first seal element of the seat; and a dart composed of a metal material and movably disposed in the bore relative to the seat for sealably engaging the first and second seal elements, the dart in a closed condition engaging the seat and preventing the fluid flow through the seat and the bore, the dart in an opened condition disengaging the seat and permitting the fluid flow through the seat and the bore.

2. The apparatus of claim 1, wherein the non-elastomeric material of the first seal element comprises a thermoplastic selected from the group consisting of polytetrafluoroethylene (PTFE), a moly-filed PTFE, and polyetheretherketone (PEEK).

3. The apparatus of claim 1, wherein the biasing element comprises an energized seal disposed in a face seal configuration and biasing the first seal element axially along the bore.

4. The apparatus of claim 3, wherein the energized seal comprises a jacket with a spring disposed therein.

5. The apparatus of claim 4, wherein the jacket is composed of a non-elastomeric material, and wherein the spring is composed of a metal material.

6. The apparatus of claim 4, wherein the spring comprises a finger spring, a coil spring, or a double-coil spring.

7. The apparatus of claim 1, wherein the second seal element comprises a portion of the body in the bore.

8. The apparatus of claim 1, wherein the first seal element comprise a jacket of an energized seal, and wherein the biasing element comprises a spring of the energized seal disposed in the jacket.

9. The apparatus of claim 8, wherein the energized seal is disposed in a rod and piston seal configuration and biased transversely to the bore.

10. The apparatus of claim 8, wherein the spring comprises a finger spring, a coil spring, or a double-coil spring.

11. The apparatus of claim 8, wherein the energized seal comprises a ring disposed on the jacket and covering the spring disposed in the jacket.

12. The apparatus of claim 1, wherein the body is adapted to couple to an external port on a side pocket mandrel.

13. The apparatus of claim 1, wherein the body is adapted to dispose in a side pocket of a side pocket mandrel.

14. The apparatus of claim 1, wherein the dart exposed to at least a first differential pressure engages the first seal element resiliently biased by the biasing element to form a resilient seal, and wherein the dart exposed to at least a second differential pressure greater than the first differential pressure engages the second seal element to form a metal-to-metal seal in addition to the resilient seal.

15. A gas lift apparatus for controlling fluid flow in a wellbore, comprising:

a mandrel having a side pocket and defining an external port therein for the fluid flow, the side pocket adapted to hold a retrievable one-way valve for preventing the fluid flow from within the mandrel to outside the mandrel through the external port; and at least one check valve attaching to the external port of the mandrel and in fluid communication with the side pocket, the at least one check valve preventing the fluid flow from within the side pocket or the one-way valve to outside the mandrel, the at least one check valve at least including:

a seat disposed in a bore of the at least one check valve and permitting the fluid flow therethrough, the seat having first and second seal elements disposed adjacent one another on the seat, the first seal element being composed of a non-elastomeric material, the second seal element being composed of a metal material, a biasing element disposed on the seat and resiliently biasing the first seal element of the seat, and a dart composed of a metal material and movably disposed in the bore relative to the seat for sealably engaging the first and second seal elements, the dart in a closed condition engaging the seat and preventing the fluid flow through the seat and the bore, the dart in an opened condition disengaging the seat and permitting the fluid flow through the seat and the bore.

16. The apparatus of claim 15, wherein the biasing element comprises an energized seal disposed in a face seal configuration and biasing the first seal element axially along the bore.

17. The apparatus of claim 16, wherein the energized seal comprises a jacket with a spring disposed therein.

18. The apparatus of claim 15, wherein the second seal element comprises a portion of the at least one check valve in the bore.

19. The apparatus of claim 15, wherein the first seal element comprise a jacket of an energized seal, and wherein the biasing element comprises a spring of the energized seal disposed in the jacket.

20. The apparatus of claim 19, wherein the energized seal is disposed in a rod and piston seal configuration and biased transversely to the bore.

21. A gas lift apparatus for controlling fluid flow in a wellbore, comprising:

a mandrel having a side pocket therein; and a first check valve retrievably disposing in the side pocket of the mandrel and preventing the fluid flow from within the mandrel to outside the mandrel, the first check valve at least including:

a seat disposed in a bore of the first check valve and permitting the fluid flow therethrough, the seat having first and second seal elements disposed adjacent one another on the seat, the first seal element being composed of a non-elastomeric material, the second seal element being composed of a metal material, a biasing element disposed on the seat and resiliently biasing the first seal element of the seat, and a dart composed of a metal material and movably disposed in the bore relative to the seat for sealably engaging the first and second seal elements, the dart in a closed condition engaging the seat and preventing the fluid flow through the seat and the bore, the dart in an opened condition disengaging the seat and permitting the fluid flow through the seat and the bore.

22. The apparatus of claim 21, further comprising a second check valve attached to the mandrel and in fluid communication with the side pocket, the second check valve preventing the fluid flow from within the side pocket or the first check valve to outside the mandrel.

23. The apparatus of claim 21, wherein the biasing element comprises an energized seal disposed in a face seal configuration and biasing the first seal element axially along the bore.

24. The apparatus of claim 23, wherein the energized seal comprises a jacket with a spring disposed therein.

25. The apparatus of claim 21, wherein the second seal element comprises a portion of the first check valve in the bore.

26. The apparatus of claim 21, wherein the first seal element comprise a jacket of an energized seal, and wherein the biasing element comprises a spring of the energized seal disposed in the jacket.

27. The apparatus of claim 26, wherein the energized seal is disposed in a rod and piston seal configuration and biased transversely to the bore.

* * * * *